United States Patent [19]

Doolittle

[11] 4,011,018

[45] Mar. 8, 1977

[54] LOOSE LEAF BINDER

[75] Inventor: Billy J. Doolittle, Springfield, Mo.

[73] Assignee: Royal Business Machines, Inc., Springfield, Mo.

[22] Filed: Sept. 10, 1975

[21] Appl. No.: 612,199

[52] U.S. Cl. ..... 402/44; 402/75; 402/80 R

[51] Int. Cl.[2] ..... B42F 13/12; B42F 13/20

[58] Field of Search ..... 402/44, 45, 75, 42, 402/31, 80 R, 26, 29

[56] References Cited

UNITED STATES PATENTS

| | | | |
|---|---|---|---|
| 693,086 | 2/1902 | Trussell | 402/44 |
| 1,663,430 | 3/1928 | Wirt | 402/44 |
| 1,670,410 | 5/1928 | Hermann | 402/44 X |
| 2,120,659 | 6/1938 | Wedge | 402/75 X |
| 2,791,220 | 5/1957 | McBee | 402/44 |
| 3,748,051 | 7/1973 | Frank | 402/75 |

FOREIGN PATENTS OR APPLICATIONS

| | | | |
|---|---|---|---|
| 736,580 | 9/1932 | France | 402/44 |
| 74,753 | 4/1917 | Switzerland | 402/44 |

*Primary Examiner*—Jerome Schnall
*Attorney, Agent, or Firm*—Norman Friedman; Robert F. Rotella; Stephen A. Roen

[57] ABSTRACT

A linking arms mechanism for a prong type loose-leaf paper binder having spacer bars with recessed portions within which curved spaced prongs are fixed and integral raised shear stops are formed which cooperate with a hinge assembly.

1 Claim, 6 Drawing Figures

LOOSE LEAF BINDER

SUMMARY OF THE INVENTION

The present invention relates to linking arms mechanisms for a prong type loose-leaf paper binder. Such mechanisms have various shortcomings which affect their usefulness. Such mechanisms use flat spacer bars to which curved spaced prongs are riveted. Since the rivet extends past the surface of the flat spacer bars a user may snag their fingers or clothing. Also, since the spacer bars have flat surfaces they do not facilitate opening and closing of the linking arms mechanism. Furthermore, such spacer bars had their end portions bent up, providing a vertical flange at each end of the spacer bar which functioned to limit the hinge assemblies pivotal movement. However, such vertical flanges presents the possibility of sharp edges or corners.

It is a principal object of this invention to provide an improved linking arms mechanism for a prong type binder adapted to hold papers of the loose-leaf variety.

A further object of the invention is to provide a linking arms mechanism of the general type specified which is easier to open and close.

A still further object of the invention is to provide a linking arms mechanism of the general type specified which eliminates any chance of someone operating it from snagging their fingers or clothing.

Another object of the invention is to provide a linking arms mechanism of the general type specified having substantially flat spacer bars constructed without right angle forms thereby eliminating any possibility of sharp edges or corners thus improving operational safety and decreasing manufacturing costs.

Various other objects will be apparent from the following description taken in conjunction with the accompanying drawings wherein:

DETAILED DESCRIPTION OF THE DRAWINGS

Figures 1, 2:
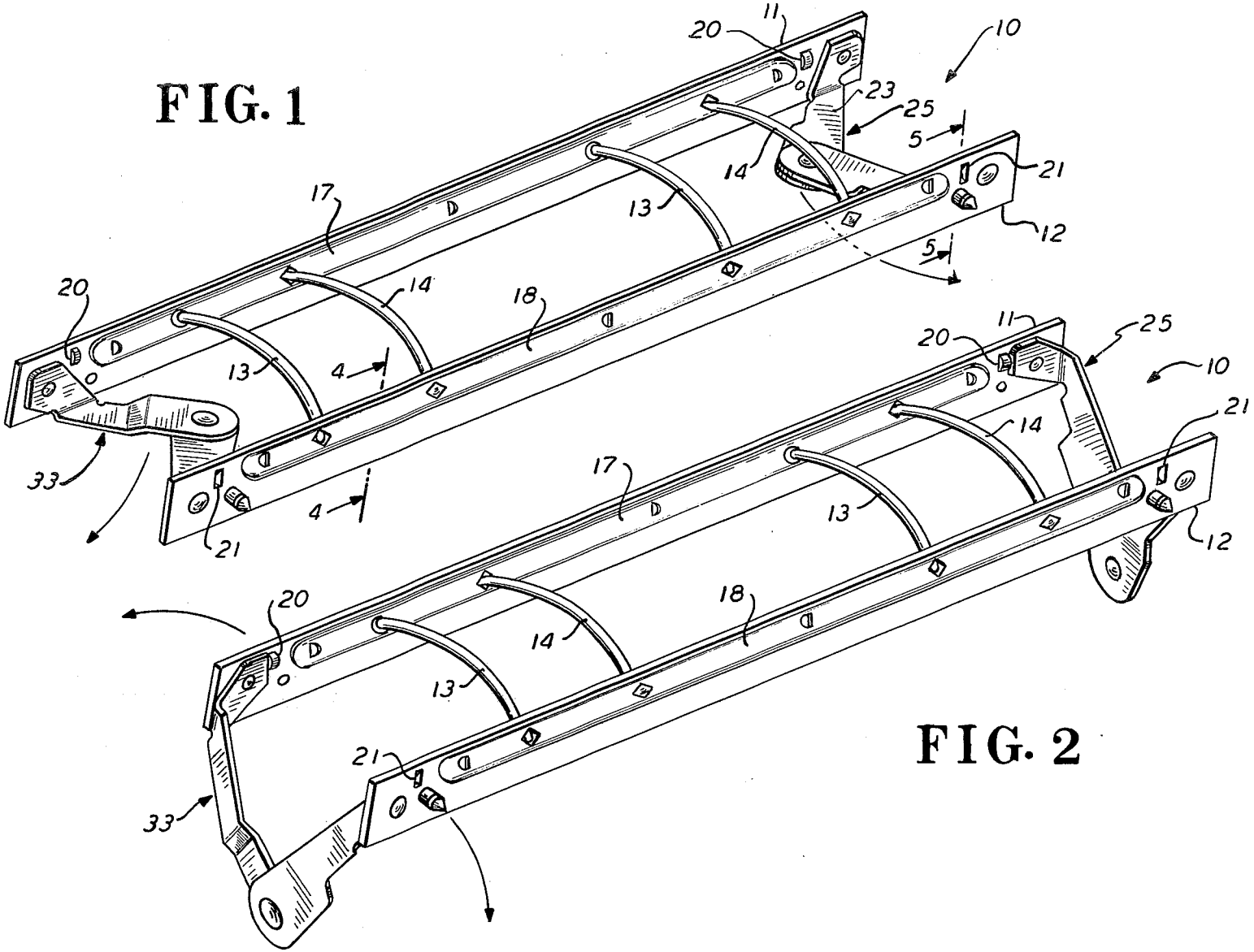
FIG. 1 is a plan view of a linking arms mechanism, the linking arms mechanism being shown in its closed position.
FIG. 2 is a similar view to that shown in FIG. 1 showing the linking arms mechanism moved to a position to release the paper holding mechanism.

Referring now to the drawings, wherein similar reference numerals are used to designate the same elements throughout the various views shown, the linking arms mechanism is generally indicated by reference numeral 10 and comprises two substantially flat spacer bars 11 and 12, the latter being riveted to an intermediate cover portion of a binder similar to that shown in U.S. Pat. No. 2,791,220, and each has mounted thereon at its inside surface two curved spaced prongs 13 and 14 respectively. The end portions of both spacer bars 11 and 12 are flat, and have inner pairs of shear form stops 20 and 21 providing flanges away from each end of the spacer bars, the purpose of which will become apparent later.

Figure 4:
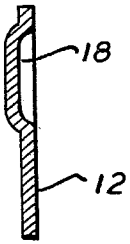
FIG. 4 is an enlarged vertical cross-sectional detail of the spacer bar taken along lines 4 — 4 of FIG. 1.

Each spacer bar 11 and 12 has a longitudinal extending recessed portion 17 and 18 respectively formed therein, the recessing being approximately equal to the thickness of the spacer bar as best shown in FIG. 4. The curved spaced prongs 13 and 14 are riveted within the recessed portions 18 and 17, respectively so that the head of the riveted prong does not extend past the outer surface of the spacer bar. Such recessing of the prong heads eliminates any chance of someone snagging their fingers or clothing.

One leg 23 of a hinge assembly, generally indicated at 25, has a flange 27 formed on the end thereof, the flange being perpendicular to the surface of the leg 23. The flange 27 is pivotally attached to the bar 11 by a rivet. A second leg 29 is pivotally connected to the leg 23 by another rivet to complete the hinge assembly. The second leg 29 has a flange 31 formed on its end, the flange extending at right angles to the surface of the leg 29 and being pivotally attached to the second flat spacer bar 12 by a rivet. The leg 29 has an offset so that the end portions of the two legs are in the same plane. A second hinge assembly, indicated generally at 33, connects the opposite ends of the bars 11 and 12, and since the two hinge assemblies are identical, further description of the second hinge is not deemed necessary.

A second set of spaced prongs 14 is rigidly mounted on the spacer bar 12, said prongs being out of register with the prongs 13 on the first spacer bar 11. A set of holes is provided in the first spacer bar 11 opposite the prongs 14 on the second spacer bar, and similarly a second set of holes is provided on the surface of the second spacer bar 12 opposite the prongs 13 attached to the first spacer bar, whereby when the paper holding mechanism is in closed position, as shown in FIG. 1, the terminal ends of the prongs will be received within the holes formed in the opposite spacer bar to add rigidity to the prongs, when in said closed position.

Figure 5:
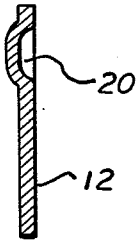
FIG. 5 is an enlarged vertical cross-sectional detail of the spacer bar taken away from its end along lines 5 — 5 of FIG. 1.

As best shown in FIG. 5 on the inside of each spacer bar 11 and 12, away from the ends, integral, raised, shear formed stops 20 and 21, respectively, are located, to prevent lateral movement of the hinge assembly in the open position and serve as stops when pivoted to the right angle position and will not allow the hinges to open farther then necessary when opening the assembly. Among other advantages such shear formed stops are cheaper and easier to manufacture than right angle stops used heretofore.

A cover latch (not shown) is adapted to latch the first spacer bar 11 to an intermediate section of a cover, when the binder is in closed relation, and is shown in detail in said aforementioned U.S. patent.

Figure 3:
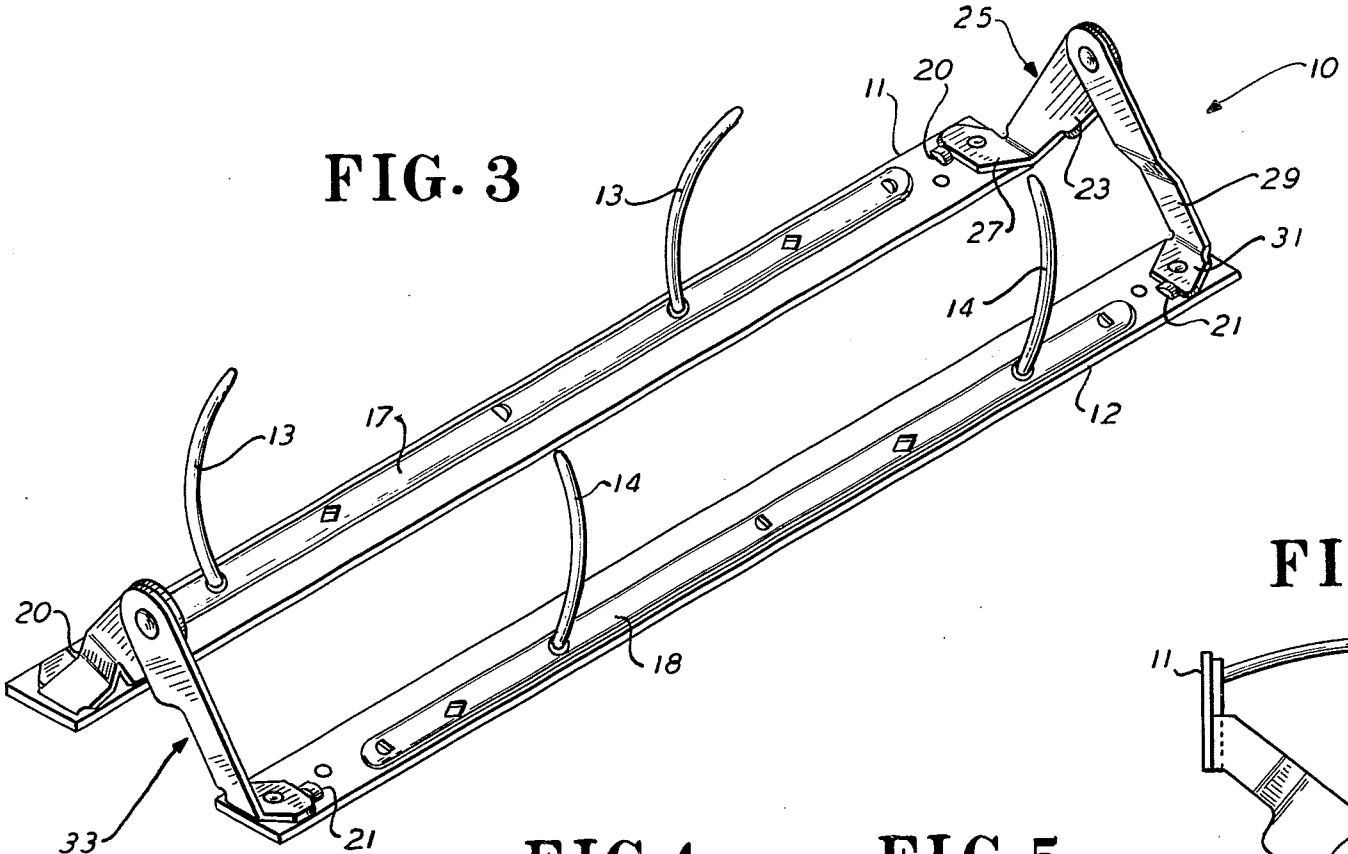
FIG. 3 is a similar view to FIG. 2 showing the paper holding mechanism swing to its open position to permit the insertion or removal of leaves.
Figure 6:
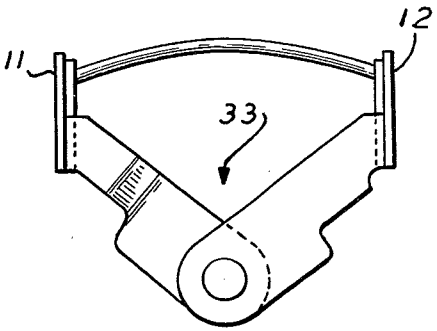
FIG. 6 is a partial view of the linking arms mechanism with the parts in the same position as in FIG. 2.

The binder using the linking arms mechanism is operated as follows: If the person using the binder is simply interested in reading the pages contained therein, the hinge mechanism is left in the relation shown in FIG. 1. However, if the person using the binder wishes to insert or remove pages therefrom, a cover latch is operated thus releasing one side of the binder. The linking arms mechanism is then swung downwardly to the position shown in FIG. 2, and the linking arms 25 and 33 are each pivoted about its pivotal connection with the spacer bars, from the position that they occupy in FIG. 1 to the position shown in FIG. 2. In the position of FIG. 2, the axes of the hinges coincide and the spacer bar 11 may be swung about these coincident axes to release the prongs from the paper in the manner shown in FIG. 3.

The recessed portions 17 and 18 of the spacer bars 11 and 12 facilitate the opening and closing of the linking arms mechanism by functioning as a gripping aid, as well as adding strength and rigidity to the spacer bars. Furthermore, as a result thereof a lighter, cheaper, gauge steel may be utilized.

While I have shown and described the preferred form of my invention, it is to be understood that various changes may be made in this construction by those skilled in the art without departing from the spirit of the invention as defined in the appended claims.

I claim:

1. A linking arms mechanism for a prong type binder comprising:

first and second elongated, longitudinally extending, substantially flat and planar spacer bars, said spacer bars being disposed in spaced apart, parallel relationship;

each of said spacer bars being provided intermediate the side edges thereof with an elongated recess extending longitudinally over a major portion of the length of each bar, said recesses each terminating short of the respective opposite ends of the related bar;

each of said recesses being defined by a portion of the related spacer bar being laterally offset toward the other spacer bar to thereby provide the base of said recess;

a first set of spaced, curved binding prongs each having one end thereof connected to and within the recess of said first spacer bar;

a second set of spaced, curved binding prongs each having one end thereof connected to and within the recess of said second spacer bar;

a pair of hinge assemblies each respectively provided at the respective opposite ends of said spacer bars, and interconnecting said spacer bars for movement toward and away from each other;

the base of each recess being provided with holes arranged to receive the free ends of the prongs of the other spacer bar when the linking arms mechanism is closed;

each of said hinge assemblies comprising:

two leaves pivotally interconnected to each other at one of their ends for pivotal movement in the plane of said leaves;

a flange connected to the terminal end of each of said leaves; and means pivotably connecting the flanges of each of said pair of hinge assemblies one to each of said spacer bars, at the portion of the latter between the extreme end of said bar and the adjacent end of the recess in said bar; each of first and second spacer bars being provided with a pair of stops respectively disposed at the opposite ends of each bar, each stop being located between the pivotal connection of a hinge assembly flange to said spacer bar and the adjacent end of the recess in said spacer bar; said stops being shear formed within said spacer bars and being cooperable with the terminal end of each of said flanges to limit pivotal movement of the latter relative to said spacer bar in the open position of said mechanism; and means for releasably and latchably coupling one of said spacer bars to a loose leaf binder cover;

whereby said recesses shield the connections of said prongs to the spacer bars and the free ends of said prongs, and also provide more easily manually graspable structure for opening and closing operation of said linking arms mechanism.

* * * * *